US006899552B1

(12) United States Patent
Robinson et al.

(10) Patent No.: US 6,899,552 B1
(45) Date of Patent: May 31, 2005

(54) GRIPPING AND LOCKING ELECTRICAL GROUNDING DEVICE FOR SINGLE AND MULTIPHASE ELECTRICAL EQUIPMENT

(76) Inventors: Weston D. Robinson, 11614 Hornbrook Dr., Houston, TX (US) 77099; Jerry T. Hicks, 11902 Marrs Dr., Houston, TX (US) 77065

( * ) Notice: Subject to any disclaimer, the term of this patent is extended or adjusted under 35 U.S.C. 154(b) by 0 days.

(21) Appl. No.: 10/758,388

(22) Filed: Jan. 14, 2004

(51) Int. Cl.[7] ..... H01R 13/648
(52) U.S. Cl. ..... 439/92; 439/133; 81/370
(58) Field of Search ..... 439/92–100, 133; 81/370

(56) References Cited

U.S. PATENT DOCUMENTS

| | | | | | |
|---|---|---|---|---|---|
| 2,978,613 | A | | 4/1961 | Hein | |
| 3,183,470 | A | | 5/1965 | Hale | |
| 3,755,772 | A | | 8/1973 | Reed | |
| 3,840,843 | A | | 10/1974 | Izraeli | |
| 3,988,051 | A | * | 10/1976 | Robinson | 439/772 |
| 4,820,901 | A | | 4/1989 | Peviani | |
| 4,889,021 | A | | 12/1989 | Morrison | |
| 4,912,949 | A | * | 4/1990 | Bowers | 70/19 |
| 4,961,742 | A | * | 10/1990 | Torre | 606/147 |
| 5,046,958 | A | | 9/1991 | Brown | |
| 5,176,527 | A | * | 1/1993 | Herbert | 439/134 |
| 5,197,359 | A | | 3/1993 | Mills | |
| 6,572,390 | B2 | * | 6/2003 | Ladin | 439/92 |
| 6,626,070 | B2 | * | 9/2003 | Peperkorn et al. | 81/370 |
| 2001/0052362 | A1 | | 12/2001 | Hasak et al. | |

* cited by examiner

*Primary Examiner*—Renee Luebke
*Assistant Examiner*—X. Chung-Trans
(74) *Attorney, Agent, or Firm*—Gary L. Bush; Andrews Kurth LLP

(57) ABSTRACT

A safety lock-out grounding device renders each of the phase leads of single phased or multi-phased electrical equipment to a grounded, safe condition to facilitate safe servicing or repair. The device has sheathed flexible phase leads and a sheathed ground conductor each being provided with an adjustable toggle actuated clamping device to establish positive clamping with the phase leads of the electrical equipment and positive clamping with a ground buss. Each of the clamping devices has relatively moveable locking components that define lock openings which become aligned when the respective adjustable toggle actuated clamping device is clamped onto a phase lead or ground buss. For positive locking of the clamping devices, to ensure that grounding of the leads of an electrical device is positively maintained during servicing or repair, a locking member of a key or combination actuated lock is inserted through the aligned openings, thus preventing unlocking movement of the clamp actuating components from the locking position thereof until the locking member has been removed from the aligned openings.

10 Claims, 2 Drawing Sheets

GRIPPING AND LOCKING ELECTRICAL GROUNDING DEVICE FOR SINGLE AND MULTIPHASE ELECTRICAL EQUIPMENT

BACKGROUND OF THE INVENTION

1. Field of the Invention

The present invention generally concerns safety devices for ensuring electrical grounding of two-phase and three-phase electrical equipment to protect workers during servicing or repair of the equipment. More particularly, the present invention concerns electrical grounding equipment that is capable of being easily and quickly connected to and removed from the exposed terminals of electrical equipment and is capable of being locked when connected, to ensure against inadvertent separation of the electrical grounding equipment from any of the terminals of the electrical equipment so that any electrical potential that may be applied to the grounding equipment goes to ground and protects workers to hazards of exposure to electrical potential.

2. Description of the Prior Art

During servicing and/or repair activities for electrical equipment, particularly three-phase electrical equipment having high voltage and/or high amperage requirements, to enable workers to safely service or repair the equipment, it is required that the electrical contacts or leads of the equipment be positively grounded. Thus, in the event the leads or contacts of the equipment should become electrically energized, the electrical potential will be conducted to ground from one or all of the electrical leads or connectors, thus ensuring that the workers remain safe from electrical shock.

Currently such safety equipment comprises a large flexible braided wire for each of the phase leads, which is covered with plastic sheathing. Each of the sheathed braided wires is provided with a clamp device that is closed by a bolt member to achieve clamping to the respective phase leads of the electrical equipment. Positioning and tightening of these phase lead clamps is often a laborious and time consuming matter, especially if the lighting in the vicinity of the machinery is poor, as is often the case. The sheathed braided wires are each connected by a junction connector to a sheathed ground lead which is typically composed of the same or similar sheathed braided flexible wire. The sheathed ground lead is provided with a grounding clamp that is also tightened or loosened with respect to a ground buss by means of an adjustment bolt or the like. The grounding clamp is often difficult to connect and maintain connected during the time period that is typically required for servicing of the machinery. Also, if the clamps are not properly positioned relative to the phase leads and the grounding buss, it is possible for the clamps to become loosened. In this event, the workers may be at risk for electrical shock without being aware of it. Since the clamps are often difficult to install and remove from the phase leads of the equipment or the ground buss, some workers may decide to risk working on the equipment without first taking the time and effort to first accomplish its safe grounding.

Another undesirable feature of the use of clamps for connection to the phase leads of the electrical equipment and the ground buss is the inability to accomplish positive locking of the clamps on the object being clamped. The clamps can be tightened for secure clamping force, but another worker can easily loosen the clamps, such as when equipment servicing or repair personnel temporarily leave the site of the electrical equipment, thus potentially rendering the equipment hazardous during subsequent servicing or repair. It is desirable therefore to provide a phase grounding assembly that can not only be positively clamped to the phase leads and the ground buss, but can also be positively locked to ensure against inadvertent loosening of the assembly or parts thereof by others.

Electrical clamping assemblies have been developed, such as is disclosed in U.S. Pat. No. 4,820,901 which employs an adjustable toggle linkage to enable desired forcible clamping of a welder's ground conductor to an object serving as a ground. A quick-release adjustable electrical grounding clamp is also disclosed in U.S. Pat. No. 3,840,843. An adjustable toggle actuated welder's grounding clamp is presented in U.S. Pat. No. 5,046,958. An adjustable toggle actuated wrench or clamping device is shown by U.S. Pat. No. 5,197,359, which is provided with a lock device P-H for preventing inadvertent release of the device from its clamping position. U.S. Pat. No. 4,889,021 illustrates another toggle actuated clamping device which is provided with a lock 11 to prevent its inadvertent release from its clamping position.

SUMMARY OF THE INVENTION

It is a principal feature of the present invention to provide a novel grounding assembly for single phase and multi-phased electrical equipment which can be simply and efficiently installed and removed from the phase leads and ground buss of electrical equipment and can be positively locked at its clamping condition to prevent inadvertent loosening of the clamping force of the phase leads and ground buss.

It is another feature of the present invention to provide a novel grounding assembly for single phase and multi-phased electrical equipment which employs phase lead conductors and a grounding conductor which are each provided with a toggle actuated clamping device to achieve desired clamping force and are capable of being locked at the desired clamping position thereof to ensure against inadvertent release of the clamping force thereof.

Briefly, the various objects and features of the present invention are achieved by providing a grounding assembly having a plurality of sheathed flexible phase leads that are connected to a shielded flexible ground conductor by a junction connector. Each of the sheathed flexible phase leads and the sheathed ground conductor is provided with an adjustable toggle actuated clamping device to establish desired clamping force thereof to the phase leads and the ground bus of the electrical equipment to which it is applied. Each of the adjustable toggle actuated clamping devices defines lock openings in relatively moveable components thereof which become aligned when the respective adjustable toggle actuated clamping device is at its clamping position. For positive locking of the adjustable toggle actuated clamping devices, the hasp element of a conventional padlock is inserted through the aligned openings, thus preventing relative movement of the clamp actuating components from the locking position thereof until the hasp of the lock has been removed from the aligned openings.

Other and further objects and features of the present invention will become apparent to one skilled in the art from a review of the detailed description of the invention which is presented herein below.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a diagrammatic illustration of a multi-phase electrical grounding device representing the prior art and shown to have conductors that are clamped to the phase leads of a three-phase electrical device, with the phase conductors each joined with a ground lead by a junction connector and with the ground lead being clamped to a ground buss;

Figure 2:
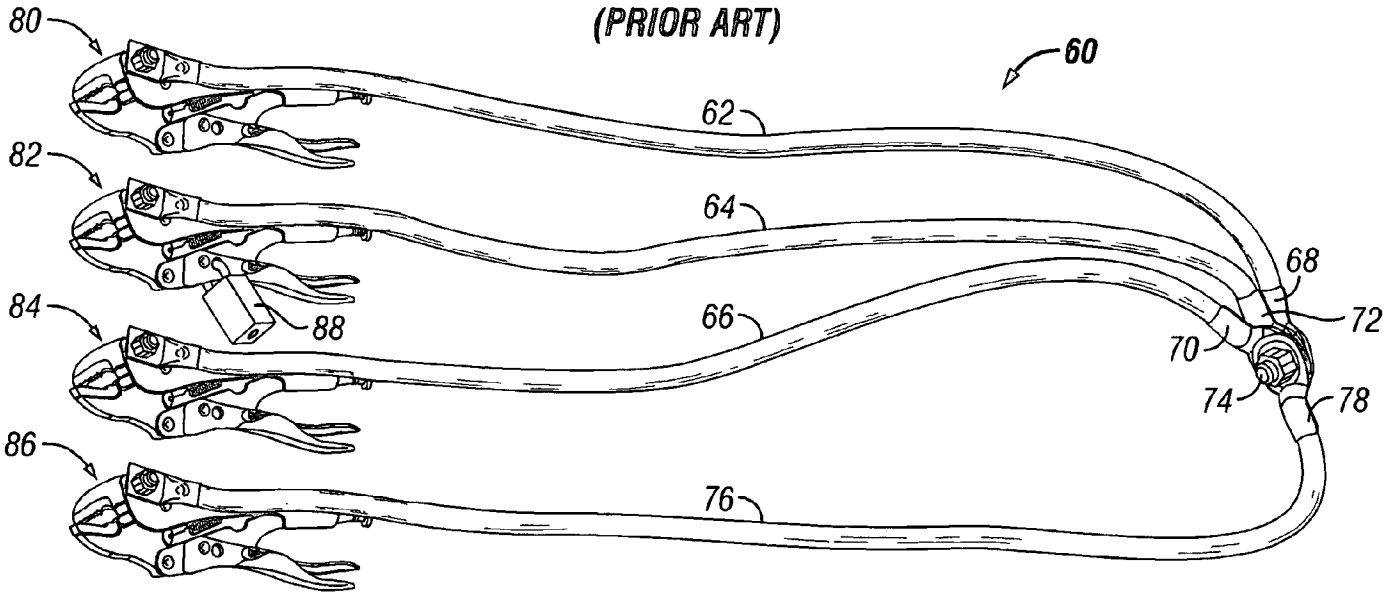
Figure 3:
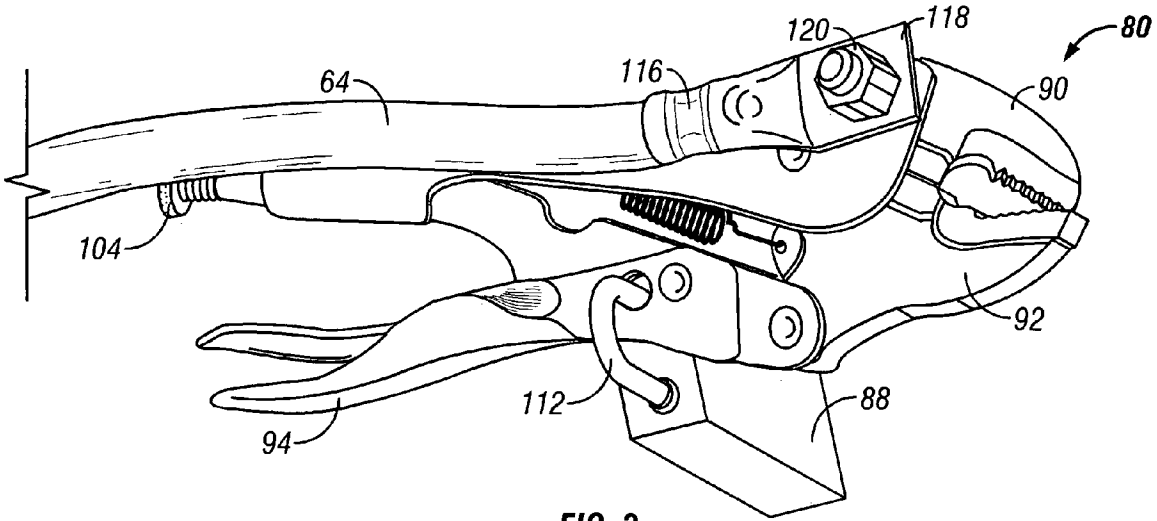
Figure 4:
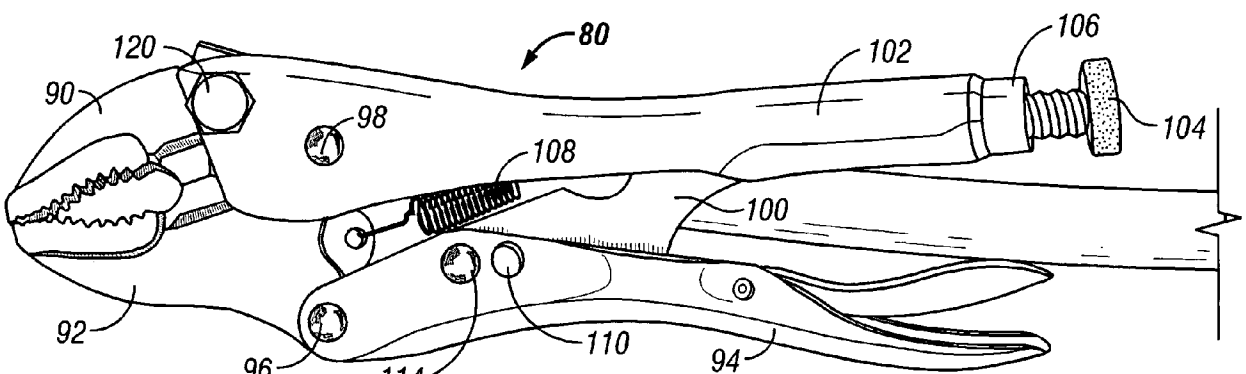

FIG. 2 is a pictorial illustration of a multi-phase electrical grounding device constructed according to the principles of the present invention and showing the use of adjustable toggle linkage clamping devices connected the individual ground conductors and a ground lead to simplify installation of the device and further showing lock devices that are installed after clamping has been achieved, to prevent inadvertent release of the clamping force of the clamping devices;

FIG. 3 is an isometric illustration of one of the adjustable toggle linkage clamping devices of FIG. 2, showing connection of an electrical ground conductor thereto and showing a lock device in place to secure the operating linkage of the adjustable toggle linkage clamping device at its clamped and locked position and preventing inadvertent release of the clamping force thereof with respect to an electrical connector or lead and a grounding device, such as a ground buss or the grounded frame of a structure; and FIG. 4 is a side elevational view of the adjustable toggle linkage clamping device of FIG. 3, showing the opposite side thereof as compared with the view of FIG. 3.

DETAILED DESCRIPTION OF PREFERRED EMBODIMENT

Figure 1:
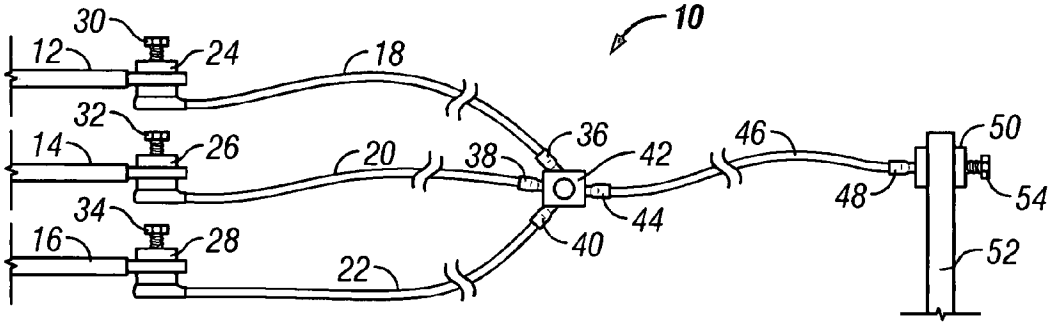
FIG. 1 (PRIOR ART)

Referring now to the drawings and first to FIG. 1, there is shown an illustration of an electrical grounding device, shown generally at 10 which is representative of the prior art. The electrical grounding device that is shown is suitable for grounding three phase electrical equipment to thus render the equipment safe for workers who are involved in servicing or repair operations. As shown in FIG. 1, the electrical equipment has a plurality of phase leads 12, 14 and 16 which may be in the form of electrical conductors as shown or, in the alternative, may be in the form of electrical connectors that are exposed at the time that servicing or repair operations are conducted. The electrical grounding equipment of the prior art includes a like number of phase grounding conductors 18, 20, and 22 that are typically composed of large, braided wire that is sheathed in a protective non-conductive covering such as may be composed of any of a number of different polymer materials. At their machine conduction ends each of the phase grounding conductors is provided with a clamp, such as shown at 24, 26 and 28, that are tightened and loosened with respect to the phase leads by adjustment of clamping bolts 30, 32 and 34.

The opposite ends of each of the phase conductors 18, 20 and 22 are also provided with connection terminals 36, 38 and 40 that are each received by a single junction connector 42 for electrical connection of each of the phase conductors to the terminal connector 44 of a single ground lead 46. At the opposite or grounding end of the ground lead 46, a terminal conductor 48 is also provided, having a clamping device 50 that is tightened or loosened with respect to a ground bus 52 by a clamping bolt 54.

The clamping devices 24, 26, 28 and 52 are typically designed for efficient clamping with respect to cylindrical or nearly cylindrical objects such as the phase leads of the electrical equipment and a ground bus in the form of a rod member. While the clamping devices may function quite well with respect to cylindrically-shaped members, in the event the phase connections or the ground bus is of another form the various clamping devices may be insecure and may easily become loosened and separated from the desired electrical connection. In such case, the phases of the electrical equipment may not be properly grounded and thus may represent a hazard to workers due to possible leakage of electrical potential. Moreover, the clamp devices are often difficult and time consuming to install so that some workers may tend to eliminate the use of electrical grounding equipment to prepare electrical equipment for servicing or repair.

Referring now to FIG. 2 there is provided an illustration of a gripping and locking electrical grounding device shown generally at 60 which incorporates three phase conductors 62, 64 and 66 that are composed of large flexible, woven electrical wire having a non-conductive protective covering of a soft, rubber-like material such as any of a number of suitable polymer materials. The three phase conductors 62, 64, and 66 are each provided with connecting terminals which are each connected to a junction connector 74. A ground lead 76 is also provided with a terminal connector 78 that is also connected with the junction connector 74. Thus, each of the three phase leads or conductors 62, 64, and 66 are electrically connected to the ground conductor 76.

Each of the phase conductors 62, 64, and 66 and the ground conductor 76 is provided with a respective gripping and clamping device shown generally at 80, 82, 84, and 86. These gripping and clamping devices are utilized to establish positive electrical connection of the respective conductors to the phase leads or phase connections of the electrical equipment and the ground bus, thus ensuring grounding of each of the phase leads of the electrical equipment for the protection of the workers involved in servicing or repairing the electrical equipment. In FIG. 2 it is shown that a lock device 88 is assembled to the gripping and locking device 82 to ensure against inadvertent unlocking of the locking device. It should be borne in mind that each of the gripping and locking devices may be provided with locks so that the equipment is locked out in compliance with typical regulations when the equipment is undergoing servicing or repair. These regulations, are provided for the protection of workers who are involved in repairing or servicing of electrical equipment, particularly multi-phased high voltage electrical equipment.

Referring now to FIGS. 3 and 4, a gripping and locking device, shown generally at 80, is generally in the form of an over center toggled linkage actuated gripping and locking device having a fixed jaw 90 and a pivotably movable jaw 92 and an actuating and locking handle 94 that is connected by a pivot member 96 to the movable jaw 92 so as to impart actuation to the movable jaw about its pivot 98. The gripping and locking device 80 is provided with an adjustment link 100 having a portion thereof received within a handle receptacle 102 and having an end portion thereof in adjustment engagement with an adjustment screw 104 that is received by an internally threaded end section 106 of the handle structure 102. A spring member 108 is interconnected with the handle structure of the gripping and locking device and is also connected with the movable jaw 92 to provide for retraction or opening of the movable jaw when the device is unlocked, thereby releasing its gripping and locking relation with an object such as a phase lead or ground bus of the nature shown in FIG. 1.

It is desirable to provide for efficient gripping and locking of the device 80 with respect to a phase lead to ground buss but it is also desirable to ensure that the gripping and locking device does not become inadvertently unlocked and opened and thus interfere with its grounding capability. To accomplish this feature, the locking handle 94 and the adjustment link 100 are provided with through-holes 110 that become aligned or registered when the locking handle 94 is at its locked position. When the holes 110 are aligned or in registry, the typically U-shaped locking member 112 of the lock device 88, which may conveniently take the form of a conventional padlock, is inserted through the aligned holes 110 and lock device 88 is moved to its locked condition. With the U-shaped locking member 112 in place within the aligned openings 110 the actuating or locking handle 94 will be incapable of pivoting about its pivot 114, thus preventing the locking handle from being moved to its jaw unlocking and opening position. This feature causes the clamping devices to maintain their clamped relation with the phase leads of the single or multi-phased electrical equipment and with the ground buss. With each of the phase leads grounded in this manner, and locked in the grounded condition, equipment service or repair activities may be safely conducted.

An electrical conductor, such as the phase conductor 64, is provided with a terminal connector 116 having a ferrule for connection with the electrical conductor, and having a flattened section 118, is assembled to the fixed jaw assembly of the gripping end clamping device by means of a typical nut and bolt assembly 120.

Operation

A worker who is engaged in servicing or repair operations with respect to electrical equipment having a single phase conductor or multiple phase conductors will typically connect the ground lead or conductor 76 to a ground buss such as shown at 52 in FIG. 1. This is accomplished by adjusting the adjustment screw 104 to thus position the movable jaw 92 with respect to the fixed jaw 90 such that when the jaws are closed and locked the gripping mechanism will apply desired gripping force to any object that is positioned between the jaws. When the adjustment screw 104 has been positioned properly to achieve the right amount of jaw gripping force, the locking handle 94 will be pivoted about its pivot 114 to accomplish pivoting movement of the movable jaw 92 about its pivot 98. After the pivot 114 has moved over-center with respect to pivot 96 and the point of contact of the adjustment link 100 with the adjustment screw 104, positive clamping and locking will have been established. At this point, the openings 110 of the locking handle 94 and the adjustment link 100 will have moved into registry or alignment. At this point the gripping and locking device will normally be locked, so as to prevent inadvertent unlocking and opening of the clamping jaws. However, to ensure that the locking handle 94 remains in its locked position with respect to the adjustment link 100, the U-shaped locking member 112 of a padlock 88 or other suitable locking device will be inserted through the aligned openings and will be independently locked. After this has been accomplished, the only way that the gripping force of the jaws of the device can be released from their locked conditions with the phase leads and ground buss is by first removing the padlock and then moving the locking handle to its open or unlocking position.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A gripping and locking electrical grounding device for grounding single phase or multiphase electrical equipment to a ground bus to render the electrical equipment safe for servicing and repair, comprising:

at least one phase conductor;

a ground conductor being coupled to said at least one phase conductor; and a gripping and locking clamp device (80) being coupled with each of said plurality of phase conductors and said ground conductor and having a fixed jaw (90) and a fixed handle assembly (102) and a moveable jaw (92) being pivotally connected with said fixed jaw and a locking handle assembly (94) and being pivotally moveable between an unlocking position permitting opening movement of said moveable jaw relative to said fixed jaw and a locking position securing said moveable jaw at a clamping position;

said gripping and locking clamp device further characterized by including an adjustment device (104) longitudinally received into a distal end of said fixed handle assembly, an adjustment link (100) having a first end pivotally coupled to said moveable jaw and a second end received in a portion of said fixed handle assembly and abutting said adjustment device, a first locking opening formed through said locking handle assembly, and a second locking opening formed through said adjustment link, wherein said adjustment device and said adjustment link cooperate to limit the maximum distance between said fixed jaw and said moveable jaw in said locking position, and said first and said second openings are in general alignment when said griping and locking clamp device is in said locking position such that a lock device may be inserted through said first and second lock openings to prevent unlocking movement of said locking handle and thus maintain positive clamping of said locking clamp device with respect to said at least one phase lead and said ground bus and maintain the electrical equipment in safe grounded condition for servicing and repair operations.

2. The gripping and locking electrical grounding device of claim 1, comprising:

said lock device being the U-shaped locking element of a pad-lock.

3. The gripping and locking electrical grounding device of claim 1, comprising:

said lock device being an elongate member extending through said aligned lock openings and being locked against unauthorized removal.

4. The gripping and locking electrical grounding device of claim 1, wherein:

said adjustment link is pivotally connected with said locking handle; and said adjustment device is mounted to said fixed jaw and handle assembly, has adjustable engagement with said adjustment link and is moveable relative to said fixed jaw and handle assembly.

5. The gripping and locking electrical grounding device of claim 1, comprising:

said lock device being the locking element of a lock having a lock body and being capable locking and unlocking conditions with respect to said lock body.

6. A gripping and locking electrical grounding device for grounding single phase or multiphase electrical equipment to a ground bus to render the electrical equipment to grounded condition and safe for servicing and repair, comprising:

a plurality of phase conductors;

a ground conductor being coupled to each of said plurality of phase conductors; and a plurality of gripping and locking clamp devices (80) being positioned in mechanically gripping and electrically coupled with each of said plurality of phase conductors and said ground conductor, each of said gripping and locking clamp devices having a fixed jaw (90) and a fixed handle assembly (102) and a moveable jaw (92) being pivotally connected with said fixed jaw and a locking handle assembly (94) and being pivotally moveable between an unlocking position permitting opening movement of said moveable jaw relative to said fixed jaw and a locking position securing said moveable jaw at a clamping position;

each of said plurality of gripping and locking clamp device further characterized by including an adjustment device (104) longitudinally received into a distal end of said fixed handle assembly, an adjustment link (100) having a first end pivotally coupled to said moveable jaw and a second end received in a portion of said fixed handle assembly and abutting said adjustment device, a first locking opening formed through said locking handle assembly, and a second locking opening formed through said adjustment link, wherein said adjustment device and said adjustment link cooperate to limit the maximum distance between said fixed jaw and said moveable jaw in said locking position, and said first and said second openings are in general alignment when said griping and locking clamp device is in said locking position such that a lock device may be inserted through said first and second lock openings to prevent unlocking movement of said locking handle and thus maintain positive clamping of said locking clamp device with respect to said at least one phase lead and said ground bus and maintain the electrical equipment in safe grounded condition for servicing and repair operations.

7. The gripping and locking electrical grounding device of claim 6, comprising:

said lock device being the U-shaped locking element of a pad-lock.

8. The gripping and locking electrical grounding device of claim 6, comprising:

said lock device being an elongate member extending through said aligned lock openings and being locked against unauthorized removal.

9. The gripping and locking electrical grounding device of claim 6, wherein each of said plurality of gripping and locking clamp devices is further characterized by;

said adjustment link is pivotally connected with said locking handle; and said adjustment device is mounted to said fixed jaw and handle assembly, has adjustable engagement with said adjustment link and is moveable relative to said fixed jaw and handle assembly.

10. The gripping and locking electrical grounding device of claim 6, comprising:

said lock device being the locking element of a lock having a lock body and being capable locking and unlocking conditions with respect to said lock body.

* * * * *